US011340537B2

(12) United States Patent
Ishino et al.

(10) Patent No.: US 11,340,537 B2
(45) Date of Patent: May 24, 2022

(54) DEVELOPMENT DEVICE AND IMAGE FORMING APPARATUS INCLUDING THE DEVELOPMENT DEVICE

(71) Applicant: KYOCERA Document Solutions Inc., Osaka (JP)

(72) Inventors: Masahito Ishino, Osaka (JP); Kotatsu Kawaguchi, Osaka (JP); Takahisa Nakaue, Osaka (JP); Yukari Ota, Osaka (JP); Tomohiro Tamaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/373,245

(22) Filed: Jul. 12, 2021

(65) Prior Publication Data

US 2022/0050401 A1 Feb. 17, 2022

(30) Foreign Application Priority Data

Jul. 17, 2020 (JP) ..... JP2020-123082
Oct. 21, 2020 (JP) ..... JP2020-176629

(51) Int. Cl.
*G03G 15/08* (2006.01)

(52) U.S. Cl.
CPC ..... *G03G 15/0812* (2013.01); *G03G 15/0808* (2013.01)

(58) Field of Classification Search
None
See application file for complete search history.

(56) References Cited

U.S. PATENT DOCUMENTS 8,032,065 B2 10/2011 Furuya
2009/0214272 A1* 8/2009 Furuya ..... G03G 15/0808 399/286

FOREIGN PATENT DOCUMENTS

JP 2001215798 A * 8/2001
JP 2004191823 A * 7/2004 ..... G03G 15/0815
JP 4612697 B2 1/2011

* cited by examiner

*Primary Examiner* — Sevan A Aydin
(74) *Attorney, Agent, or Firm* — Studebaker & Brackett PC

(57) ABSTRACT

A development device includes a development housing, a development roller, a supply roller and a layer thickness regulating member. The development housing stores a non-magnetic one-component toner. The development roller is formed by a cylindrical elastic body, and moves in a same direction as a rotational direction of a rotatable photosensitive drum at a development nip area while coming into contact with the photosensitive drum. The supply roller is formed by a cylindrical elastic body, and supplies the toner to the development roller and collects the toner from the development roller. The development roller has a surface free energy within a range of 5 mJ/m$^2$ or more and 27 mJ/m$^2$ or less.

9 Claims, 14 Drawing Sheets

DEVELOPMENT DEVICE AND IMAGE FORMING APPARATUS INCLUDING THE DEVELOPMENT DEVICE

INCORPORATION BY REFERENCE

This application is based on and claims the benefits of priority from Japanese patent applications No. 2020-123082 filed on Jul. 17, 2020 and No. 2020-176629 filed on Oct. 21, 2020, which are incorporated by reference in its entirety.

BACKGROUND

The present disclosure relates to a development device which develops an electrostatic latent image formed on a photosensitive drum by a nonmagnetic one-component developer, and an image forming apparatus including the development device.

An image forming apparatus such as a printer includes a development device which develops an electrostatic latent image formed on a photosensitive drum by a nonmagnetic one-component developer. As the development device, a contact type nonmagnetic one-component development device is known. The development device includes a development roller which forms a toner image on the photosensitive drum and a supply roller which supplies the toner to the development roller.

In such a contact type nonmagnetic one-component development device, the toner is directly rubbed by the supply roller to the development roller to be triboelectrically charged, and at the same time, the toner is attracted to the development roller and conveyed to the photosensitive drum by the development roller. Then, the photosensitive drum and the development roller are brought into contact with each other and rotated to develop the toner on the photosensitive drum. As a result, members such as a magnet, a metal sleeve, and a carrier are not required unlike in a conventional two-component development device or a non-contact jumping one-component development device, and it is not required to apply an AC bias to the development roller. Thus, stable development performance can be obtained in a simple and low-cost configuration. Further, since the development roller comes into contact with the photosensitive drum, it becomes possible to collect the toner on the photosensitive drum into the development device, and the cleaning blade becomes unnecessary (cleaning blade less), thereby making not only the structure of the development device but also the entire structure around the photosensitive drum simple. For the reasons described above, the contact type nonmagnetic one-component development device is widely used mainly in a low-speed compact image forming apparatus and printer.

In such a development device, by setting an arithmetic average surface roughness and a surface energy of the surface of the development roller, and an Asker F hardness of the supply roller to respective predetermined ranges, generation of an afterimage caused by the undeveloped toner remaining on the unevenness of the surface of the development roller can be prevented, and the density of the image can be increased by increasing a carrying force of the developer.

However, the above-described technique has a problem that it is difficult to secure a development bias setting range in which both the target image density and the cleaning property of the undeveloped toner can be achieved, over a long period of time.

SUMMARY

In accordance with an aspect of the present disclosure, a development device includes a development housing, a development roller, a supply roller and a layer thickness regulating member. The development housing stores a nonmagnetic one-component toner. The development roller is formed by a cylindrical elastic body, is supported by the development housing in a rotatable manner so as to move in a same direction as a rotational direction of a rotatable photosensitive drum at a development nip area while coming into contact with the photosensitive drum, and has a circumferential face on which the toner is carried. The photosensitive drum has a surface on which an electrostatic latent image is carried. The supply roller formed by a cylindrical elastic body, supported by the development housing in a rotatable manner, comes into contact with the circumferential face of the development roller to form a supply nip area between the supply roller and the development roller, supplies the toner to the development roller and collects the toner from the development roller. The layer thickness regulating member comes into contact with the circumferential face of the development roller on a downstream side of the supply nip area in a rotational direction of the development roller and on an upstream side of the development nip area in the rotational direction of the development roller, and regulates a thickness of the toner on the development roller. The development roller has a surface free energy within a range of 5 $mJ/m^2$ or more and 27 $mJ/m^2$ or less.

In accordance with an aspect of the present disclosure, an image forming apparatus includes the development device, the photosensitive drum which receives the toner from the development roller and carries a toner image corresponding to the electrostatic latent image and a transferring member which transfers the toner image from the photosensitive drum to a sheet.

The other features and advantages of the present disclosure will become more apparent from the following description. In the detailed description, reference is made to the accompanying drawings, and preferred embodiments of the present disclosure are shown by way of example in the accompanying drawings.

DETAILED DESCRIPTION

Figure 1:
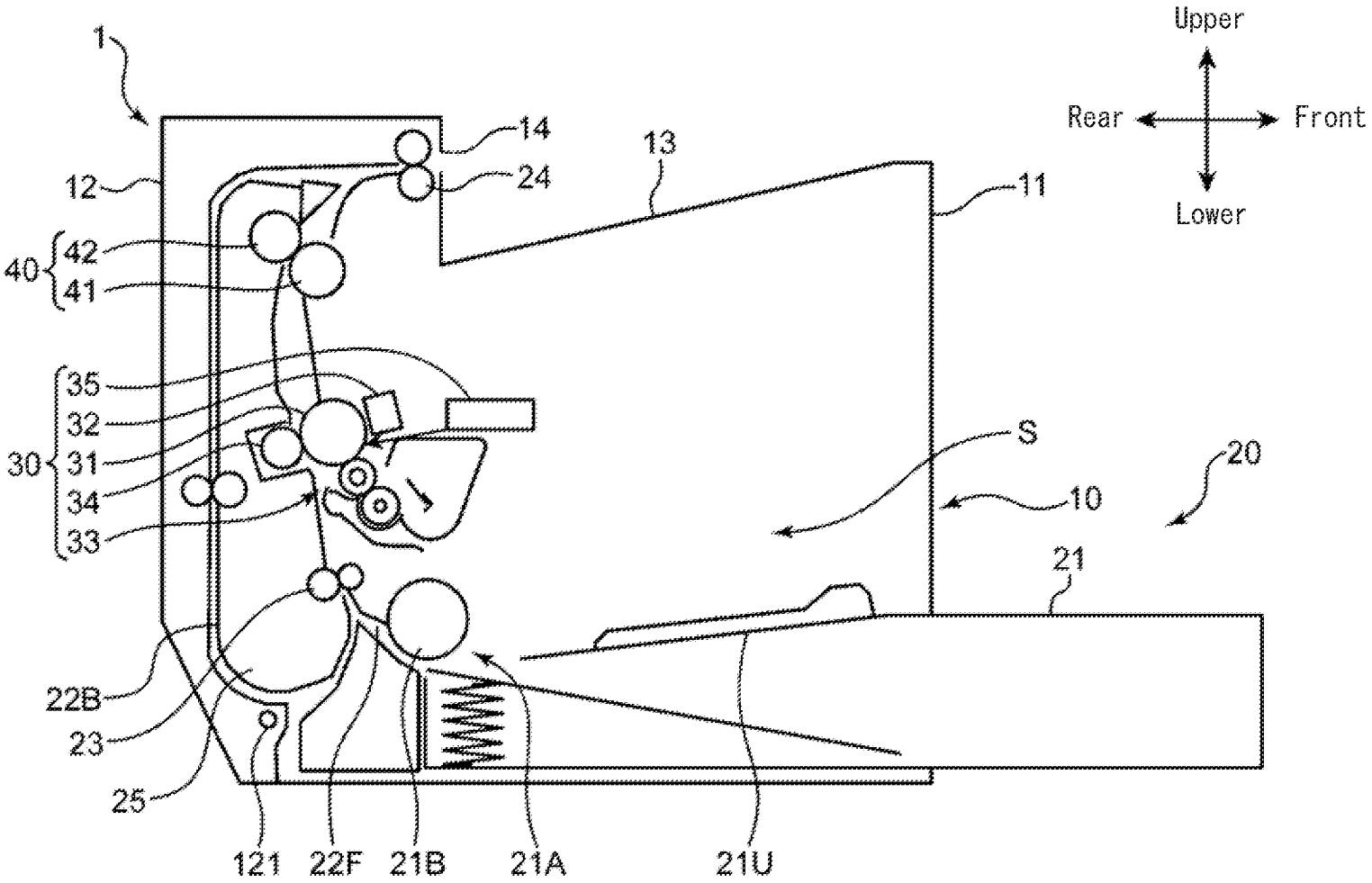
FIG. 1 is a sectional view showing an inner structure of an image forming apparatus according to one embodiment of the present disclosure.

Hereinafter, with reference to the attached drawings, an embodiment of the present disclosure will be described. FIG. 1 is a sectional view showing an inner structure of an image forming apparatus 1 according to the embodiment of the present disclosure. Here, a monochrome printer is shown as an example of the image forming apparatus 1, but the image forming apparatus may be a copying machine, a facsimile machine, a multifunctional peripheral containing function of these machines, or a full color image forming apparatus.

The image forming apparatus 1 includes a main housing 10 having an approximately parallelepiped shaped casing structure, a sheet feeding part 20, an image forming part 30 and a fixing part 40 which are stored in the main housing 10.

On the front face of the main housing 10, a front cover 11 is provided, and on the rear face of the main housing 10, a rear cover 12 is provided. The rear cover 12 is opened at a sheet jamming or a maintenance work. On the top face of the main housing 10, a discharge part 13 is provided, to which a sheet with an image is discharged. In an inner space S formed by the front cover 11, the rear cover 12 and the discharge part 13, various devices performing image forming processing are stored.

The sheet feeding part 20 includes a sheet feeding cassette 21 in which the sheet on which the image is formed is stored. One portion of the sheet feeding cassette 21 is protruded more forward than the front face of the main housing 10. The upper face of the other portion of the sheet feeding cassette 21 stored in the main housing 10 is covered with a sheet feeding cassette top plate 21U. The sheet feeding cassette 21 is provided with a sheet storage space in which a bundle of the sheets is stored and a lift plate which lifts the sheet bundle for feeding. Above the rear end portion of the sheet feeding cassette 21, a sheet feeding part 21A is provided. The sheet feeding part 21A includes a sheet feeding roller 21B which feeds the uppermost sheet of the sheet bundle in the sheet feeding cassette 21 one by one.

The image forming part 30 performs the image forming processing for forming the image on the sheet fed from the sheet feeding part 20. The image forming part 30 includes a photosensitive drum 31, a charging device 32, an exposure device 35, a development device 33, and a transferring roller 34 which are disposed around the photosensitive drum 31.

The photosensitive drum 31 includes a rotational shaft and a cylindrical face rotating around the rotational shaft. On the cylindrical face, an electrostatic latent image is formed and a toner image corresponding to the electrostatic latent image is carried. As the photosensitive drum 31, an OPC photosensitive drum may be used.

The charging device 32 charges the surface of the photosensitive drum 31 uniformly, and includes a scorotron disposed at a predetermined interval to the photosensitive drum 31 and discharging when applied with a predetermined voltage.

The exposure device 35 includes a laser light source and an optical element such as a mirror or a lens, and emits modulated light (exposure light) based on an image data (image information) output from an external device, such as a personal computer, to the circumferential face of the photosensitive drum 31 to form the electrostatic latent image.

The development device 33 supplies the toner to the circumferential face of the photosensitive drum 31 in order to develop the electrostatic latent image into the toner image.

The transferring roller 34 (a transferring member) transfers the toner image formed on the circumferential face of the photosensitive drum 31 to the sheet. The transferring roller 34 comes into contact with the cylindrical face of the photosensitive drum 31 to form a transferring nip area. To the transferring roller 34, a transferring bias having a reverse polarity to the toner is applied.

The fixing part 40 performs a fixing processing for fixing the transferred toner image on the sheet. The fixing part 40 includes a fixing roller 41 in which a heating source is stored, and a pressing roller 42 coming into pressure contact with the fixing roller 41. Between the fixing roller 41 and the pressing roller 42, a fixing nip area is formed. When the sheet to which the toner image is transferred is passed through the fixing nip area, the toner image is heated by the fixing roller 41 and pressed by the pressing roller 42, and then fixed on the sheet. In the present embodiment, a melt viscosity (Ps·s) of the nonmagnetic one-component toner used in the development device 33 at 95° c. is set within a range of 100,000 or more and 200,000 or less.

In the main housing 10, a main conveyance path 22F and an inversion conveyance path 22B are provided for conveying the sheet. The main conveyance path 22F extends from the sheet feeding part 21A of the sheet feeding part 20 to a discharge port 14 provided so as to face of the discharge part 13 on the top face of the main housing 10 via the image forming part 30 and the fixing part 40. The inversion conveyance path 22B is a conveyance path for conveying the sheet printed on one face to the upstream side of the image forming part 30 on the main conveyance path 22F when the both-face printing is performed on the sheet.

The main conveyance path 22F is formed through the transferring nip area between the photosensitive drum 31 and the transferring roller 34 from the lower side to the upper side. On the upstream side of the transferring nip area on the main conveyance path 22F, a registration rollers pair 23 is disposed. The sheet is stopped by the registration rollers pair 23, and then fed to the transferring nip area at a timing suitable for image transferring after the skew of the sheet is corrected. At suitable positions on the main conveyance path 22F and the inversion conveyance path 22B, a plurality of conveyance rollers for conveying the sheet is disposed, and a discharge rollers pair 24 is disposed near the discharge port 14, for example.

The inversion conveyance path 22B is formed between the outer side face of an inversion unit 25 and the inner face of the rear cover 12 of the main housing 10. The transferring roller 34 and one roller of the registration rollers pair 23 are mounted on the inner face of the inversion unit 25. The rear cover 12 and the inversion unit 25 are each rotatable around an axis of a fulcrum part 121 provided at their lower end portions. When a sheet jamming occurs on the inversion conveyance path 22B, the rear cover 12 is opened. When a sheet jamming occurs on the main conveying path 22F, or when the unit of the photosensitive drum 31 or the development device 33 is detached to the outside, the inversion unit 25 is also opened in addition to the rear cover 12.

Figure 2:
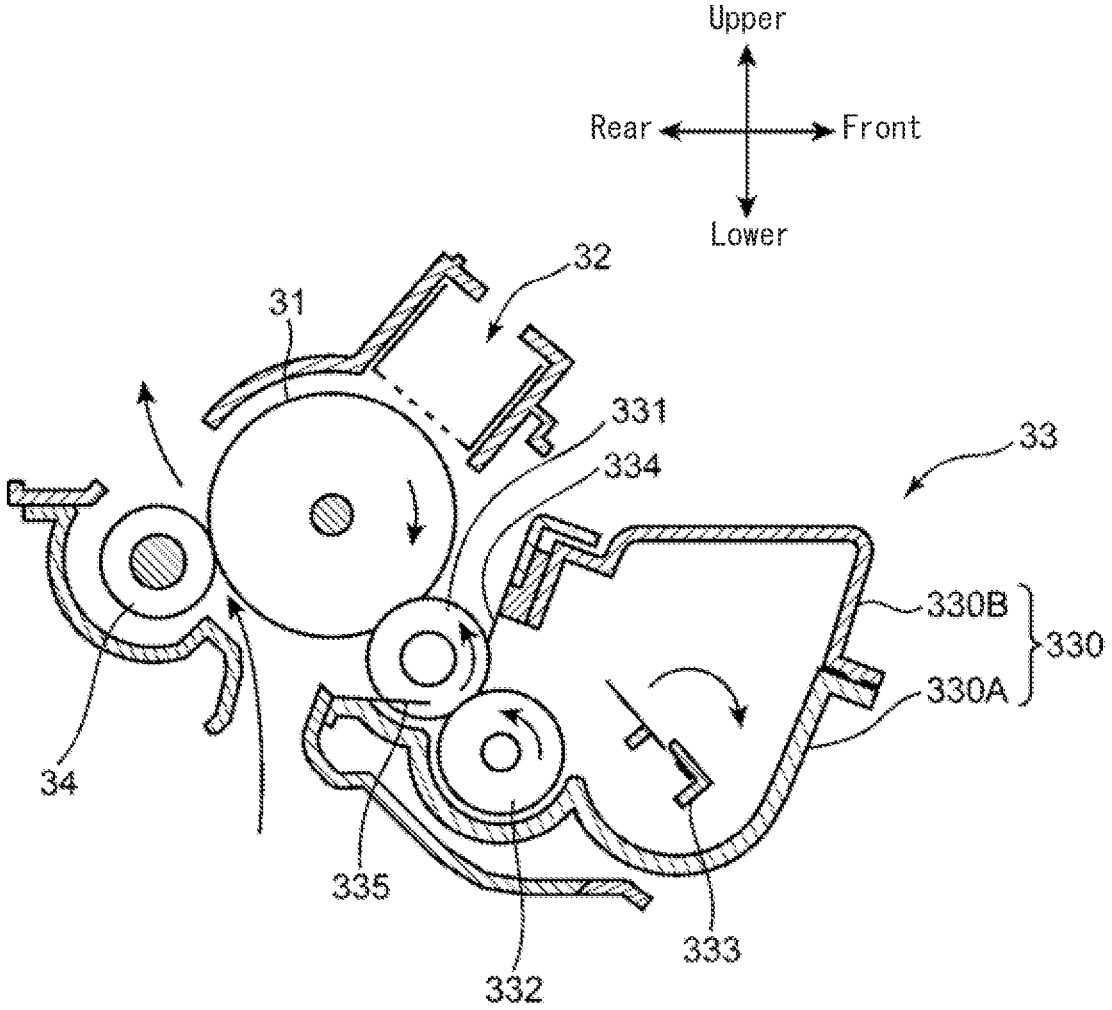
FIG. 2 is a sectional view showing a photosensitive drum and its periphery of the image forming apparatus according to the embodiment of the present disclosure.

FIG. 2 is a sectional view showing a structure around the photosensitive drum 31. In this embodiment, the transferring roller 34 is disposed so as to come into contact with the photosensitive drum 31 on the rear side of the photosensitive drum 31, and the charging device 32 is disposed so as to face the photosensitive drum 31 at a predetermined interval on the front and upper side of the photosensitive drum 31. The transferring nip area is formed between the photosensitive drum 31 and the transferring roller 34, and the sheet passes through the transferring nip area as indicated by the arrow in FIG. 2. At this time, the toner image is transferred from the photosensitive drum 31 to the sheet.

The development device 33 is disposed so as to face the photosensitive drum 31 on the front and lower side of the photosensitive drum 31. The development device 33 includes a development housing 330, a development roller 331, a supply roller 332, an agitating paddle 333, a regulating blade 334 (a layer thickness regulating member), and a lower seal 335 (a sealing member).

The development housing 330 stores the nonmagnetic one-component toner. The development housing 330 includes a housing main body 330A and a housing lid 330B. As shown in FIG. 2, in the rear end portion of the development housing 330, an opening for exposing a part of the development roller 331 to the photosensitive drum 31 is formed.

The development roller 331 is supported by the development housing 330 in a rotatable manner, and has a circumferential face on which the toner is carried. The development roller 331 comes into contact with photosensitive drum 31, and forms a development nip area together with the photosensitive drum 31 for supplying the toner to the photosensitive drum 31. The development roller 331 has a shaft made of SUS or SUM, and a cylindrical rubber layer (an elastic body) around the shaft. The rubber layer is made of NBR (Nitril-Butadiene rubber), for example. A predetermined coating layer may be formed around the rubber layer. In the present embodiment, an Asker-C hardness of the surface of the development roller 331 is set within a range of 50 or more and 80 or less. The development roller 331 is applied with a development bias of a direct voltage. Owing to a difference in potential between the electrostatic latent image on the photosensitive drum 31 and the development roller 331 applied with the development bias, the toner is attracted to the photosensitive drum 31 from the development roller 331.

The supply roller 332 is disposed so as to face the development roller 331 on the front and lower side of the development roller 331, and supported by the development housing 220 in a rotatable manner. The supply roller 332 comes into contact with the development roller 331, and forms a supply nip area for supplying the toner to the development roller 331. The supply roller 332 has a predetermined shaft (a shaft member) made of metal, and a cylindrical urethane sponge or foamed sponge (both are an elastic foamed member) fixed around the shaft. In the present embodiment, an Asker-FP hardness of the surface of the supply roller 332 is set within a range of 40 or more to 60 or less. A width of the supply nip area is set within a range of 0.2 mm or more and 1.5 mm or less in the rotational direction when viewed along the radial direction.

The agitating paddle 333 is supported by the development housing 330 in a rotatable manner on the front side of the supply roller 332. The agitating paddle 333 includes a shaft having a L-shaped cross section as shown in FIG. 2 and a PET film extending radially from the shaft.

FIG. 2 shows rotational directions of the development roller 331, the supply roller 332 and the agitating paddle 333 when the image forming processing to the sheet is performed in the image forming apparatus 1. The development roller 331 rotates such that its surface moves in the same direction as the surface of the photosensitive drum 31 at the development nip area (the development roller 331 rotates in a direction opposite to the rotational direction of the photosensitive drum 31). As an example, a circumferential speed ratio of the development roller 331 to the photosensitive drum 31 is set to 1.55. The supply roller 332 rotates such that its surface moves in a direction opposite to the surface of the development roller 331. A circumferential speed ratio of the development roller 331 to the supply roller 332 is set to 1.55. The agitating paddle 333 rotates so as to scoop the toner in the development housing 330 and to supply it to the supply roller 332.

The regulating blade 334 comes into contact with the surface (the circumferential face) of the development roller 331 on the downstream side of the supply nip area in the rotational direction of the development roller 331 and on the upstream side of the development nip area in the rotational direction of the development roller 331. The regulating blade 334 is fixed to the development housing 330 so as to be inclined toward the upstream side in the rotational direction of the development roller 331. The regulating blade 334 regulates a thickness (a layer thickness) of the toner on the development roller 331.

The lower seal 335 is supported by the housing main body 330A so as to be close to a gap between the development roller 331 and the housing main body 330A on a side opposite to the regulating blade 334. The tip end portion of the lower seal 335 comes into contact with the surface of the development roller 331.

In the present embodiment, as shown in FIG. 2, the so-called cleanerless configuration is adopted in which the charging device 32 is disposed on the downstream side of the photosensitive drum 31 in the rotational direction of the photosensitive drum 31 as viewed from the transferring nip area between the photosensitive drum 31 and the transferring roller 34, and a known cleaning device is not provided. That is, when the toner image is transferred from the photosensitive drum 31 to the sheet at the transferring nip area, the untransferred toner remains on the photosensitive drum 31. The untransferred toner passes through the charging device 32 and is collected from the photosensitive drum 31 by the development roller 331 of the development device 33. At this time, when the images (the toner images) are continuously formed on the sheet, the development roller 331 collects the untransferred toner from the photosensitive drum 31 and supplies the toner to the electrostatic latent image on the photosensitive drum 31.

On the other hand, the supply roller 332 supplies the new toner to the development roller 331 at the supply nip area and collects the toner not supplied to the photosensitive drum 31 from the development roller 331 from the development roller 331.

Figure 3:
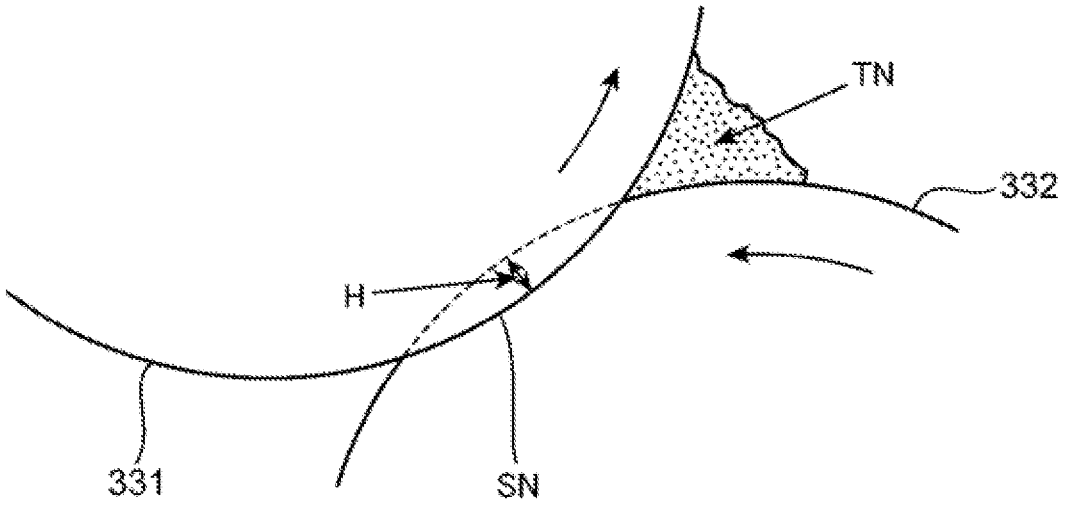
FIG. 3 is an enlarged sectional view showing a supply nip area between a development roller and a supply roller of a development device according to the embodiment of the present disclosure.

FIG. 3 is an enlarged sectional view showing an area where the development roller 331 faces the supply roller 332 in the development device 33 according to the embodiment of the present disclosure. In the embodiment, the shaft of the development roller 331 and the shaft of the supply roller 332 are supported by the development housing 330 such that the surface of the development roller 331 bites the surface of the supply roller 332 by a biting amount H. As a result, between the development roller 331 and the supply roller 332, a supply nip area SN having a predetermined width along their rotational directions is formed. Because the supply roller 332 has a hardness smaller than the development roller 331, as shown in FIG. 3, the surface of the supply roller 332 is mainly deformed to form the supply nip area SN. Therefore, when the development roller 331 and the supply roller 332 are rotated, the toner supplied by the supply roller 332 remains on the upstream side of the supply nip area SN, and a toner accumulation TN is formed. The toner accumulation TN allows to supply the toner from the supply roller 332 to the development roller 331 stably even if the high-density image is formed on the photosensitive drum 31.

On the other hand, when the development roller 331 and the supply roller 332 may come into point contact with each other in the sectional view, because the sufficient toner accumulation TN shown in FIG. 3 is not formed, a toner supply performance may be remarkably decreased.

Therefore, it is necessary to set a center distance (a shaft distance) between the development roller 331 and the supply roller 332 and their diameters so as to have an appropriate biting amount H. An asker-C hardness of the development roller 331 is set within a range of 50 or more and 80 or less because the development roller 331 comes into contact with the hard member such as the photosensitive drum 31. Accordingly, in order to have the configuration in which the development roller 331 bites the supply roller 332 as shown in FIG. 3, it is necessary to set a hardness of the supply roller 332 smaller than the development roller 331.

Figure 4:
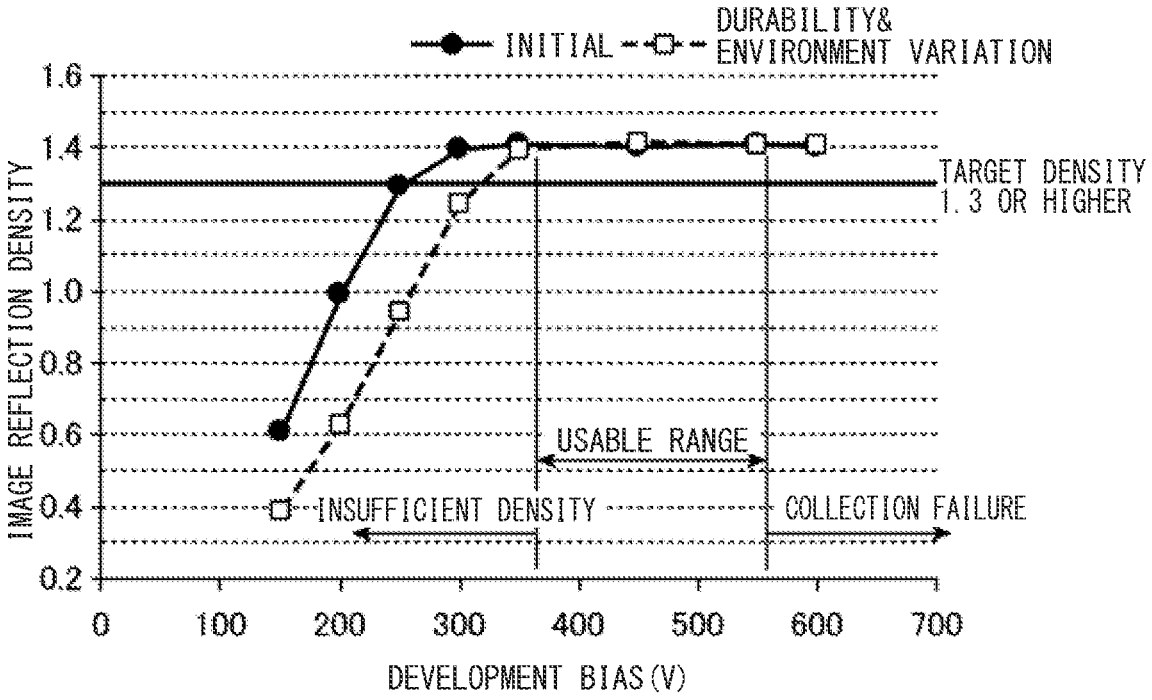
FIG. 4 is a graph showing a relationship between a development bias and an image density in a nonmagnetic one-component development device.

<Usable Range of Development Bias> FIG. 4 is a graph showing a relationship between a development bias and an image density in a nonmagnetic one-component development device. The image density is shown by a reflection density on the sheet measured using a TC-6DX manufactured by TokyoDenshoku. Co., Ltd. In the following graph, the image density is shown in the same manner.

A performance of the image forming apparatus to which a contact type nonmagnetic one-component development system in which the development roller 331 comes into contact with the circumferential face of the photosensitive drum 31 and a cleanerless system (a cleaning bladeless system) are adopted is represented as a development sensitivity property shown in FIG. 4. The development bias applied to the development roller 331 is adjusted such that an image density on the sheet has the preset target density and cleaning failure (collecting failure) is not generated on the photosensitive drum 31. The image density corresponds to an amount of the toner moved from the development roller 331 to the photosensitive drum 31 (a development amount), and varies depending on a difference in potential between the photosensitive drum 31 after exposed and a development bias (a direct voltage). The generation of the cleaning failure is varied depending on a difference in potential between a surface potential of the photosensitive drum 31 (a potential of a background) and a development bias. Thus, there is a usage range of the development bias in which the target image density is obtained and the cleaning failure does not occur. FIG. 4 shows a relationship between a development bias and an image density under various conditions including a condition where the image forming apparatus 1 is in an initial state (represented as the black circles), and conditions where the image forming apparatus 1 has been used for a long period of time (durability) and a surrounding environment of the image forming apparatus 1 changes (represented as the white rectangles). The usable range of the development bias is shown as a range where the target image density (1.3 or more) is obtained, an insufficiency of the image density is not generated, and the cleaning failure (the collection failure) does not occur, in the conditions. In consideration of a potential unevenness on the photosensitive drum 31, a deterioration of the toner and a variation in the development sensitivity owing to an environment (humidity and temperature), the usable range of the development bias is preferably set in a range of at least 120 V. It is important for the contact type nonmagnetic one-component development system to secure the usable range as wide as possible.

Figure 5:
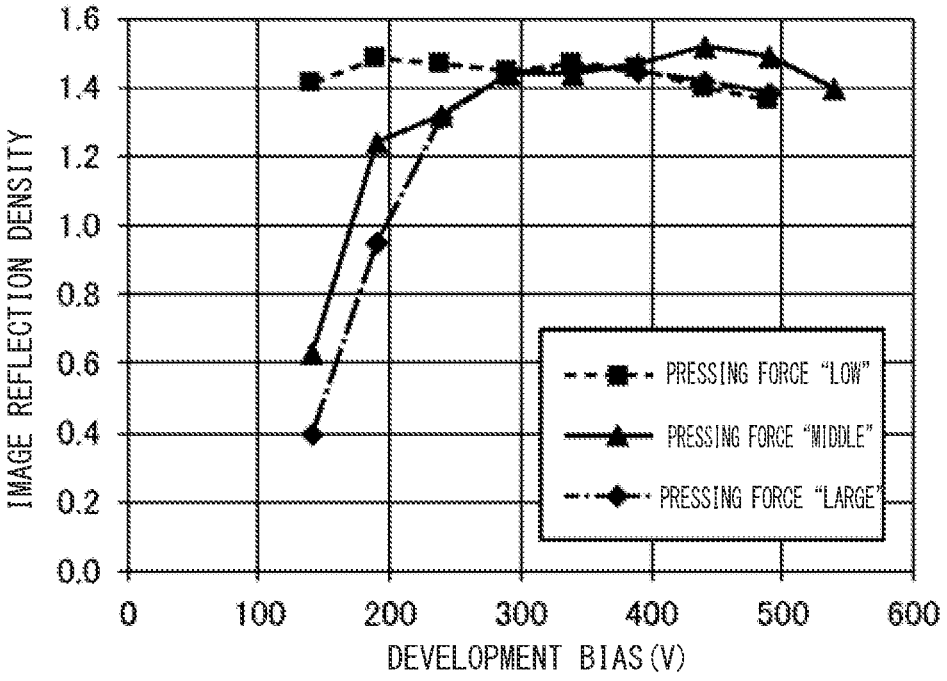
FIG. 5 is a graph showing a relationship between a development bias and an image density in the nonmagnetic one-component development device.
Figure 6:
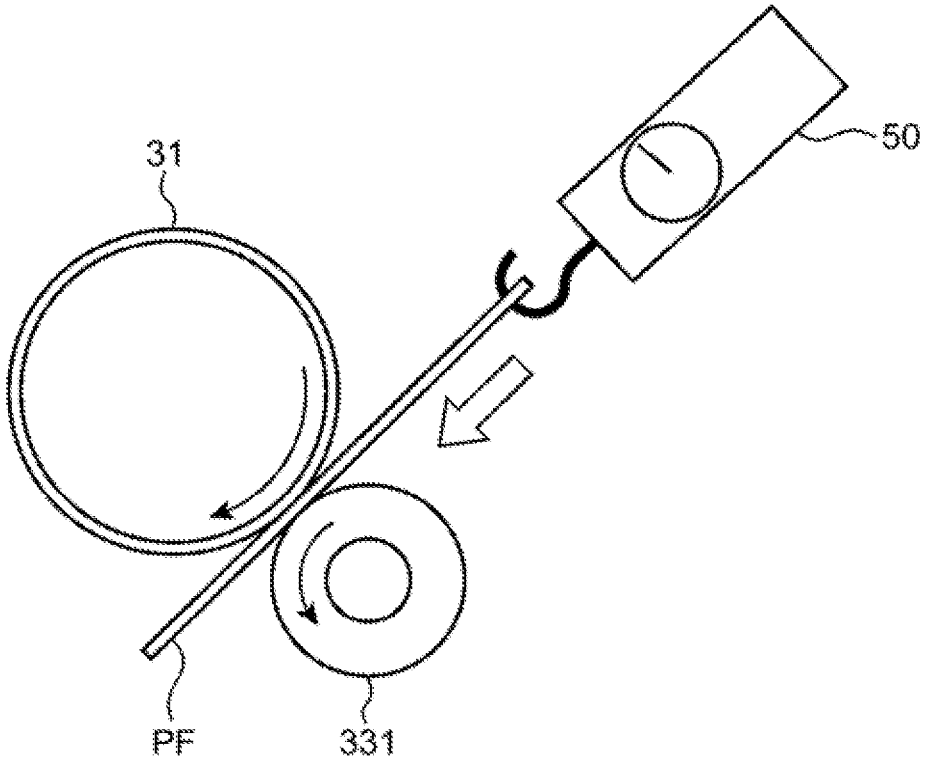
FIG. 6 is a view showing a way to measure a pulling force in a development nip area in the development device according to the embodiment of the present disclosure.
Figure 7:
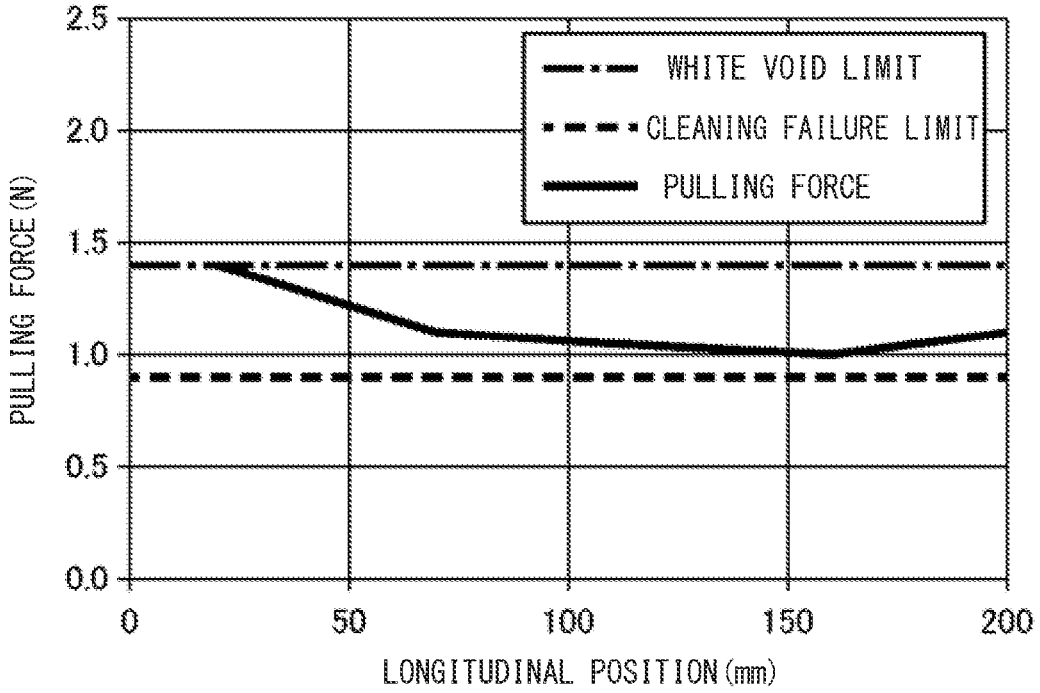
FIG. 7 is a graph showing a distribution in the pulling force in the development nip area in the development device according to the embodiment of the present disclosure.

<Pressing Force of Development Roller and Image Density> FIG. 5 is a graph showing a relationship between a development bias and an image density in the nonmagnetic one-component development device. FIG. 5 shows graphs of the cases where a pressing force (a contact pressure) of the development roller 331 against the photosensitive drum 31 is changed at three levels (the pressing force is low, medium, or high). FIG. 6 is a view showing a state where a pulling force in the development nip area is measured in the nonmagnetic one-component development device. FIG. 7 is a graph showing a distribution of the pulling force in the development nip area of the development device 33 according to the present embodiment.

In the development device 33 according to the present embodiment, the photosensitive drum 31 is directly brought into pressure contact with the development roller 331, and the development sensitivity is changed by the pressing force at this time. As shown in FIG. 5, when the pressing force is too large, an image density is insufficient in a region where the development bias is low, and white void is generated in the halftone image. The mechanism of this phenomenon is inferred as follows. The larger the pressing force of the development roller 331 against the photosensitive drum 31 is, the larger the micro-contact area between "the toner" and "the surface of the development roller" is, and the larger the adhesion force of the toner to the development roller 331 is. As a result, the toner hardly separates from the development roller 331, the development amount to the photosensitive drum 31 is decreased, and the image density is thus lowered.

On the other hand, if the pressing force is too small, the development roller 331 hardly collects the untransferred toner (also called the remaining toner) on the photosensitive drum 31, and the cleaning failure thus occurs. Therefore, the pressing force of the development roller 331 has an appropriate range, and it is required to secure the pressing force along the longitudinal direction (the axial direction) of the development roller 331 as uniform as possible. In the present embodiment, the pressing force of the development roller 331 is indirectly evaluated by substituting a pulling force using a PET film for the pressing force at the development nip area during the rotation of the photosensitive drum 31 and the development roller 331. As shown in FIG. 6, a PET film having an axial width of 20 mm and a thickness of 50 μm is held between the photosensitive drum 31 and the development roller 331, and the pulling force applied to the PET film (shown by PF in FIG. 6) when the photosensitive drum 31 and the development roller 331 were rotated was measured by a push-pull gauge 50 disposed on the upstream side of the development roller 331 in the rotational direction of the development roller 331 as viewed from the development nip area.

As shown in FIG. 7, when the pressing force of the development roller 331 against the photosensitive drum 31 at the development nip area is substituted by the above-described pulling force, when the pulling force is below 0.9 (N), the collection failure (cleaning failure) occurs, and when it exceeds 1.4 (N), the white void is generated in the halftone image. Therefore, it is desirable that the pulling force be set to an appropriate range from 0.9 (N) or more and 1.4 (N) or less over the entire axial direction of the development roller 331. That is, in the development device 33 of the nonmagnetic one-component system, when "the usable range of the development bias" and "the appropriate range of the pressing force of the development roller" are secured as widely as possible, the simple and low-cost image forming apparatus 1 can be provided.

In order to realize the image forming apparatus 1 provided with the above development device 33, the inventors of the present disclosure have carried out intensive experiments, and have newly found that there is a close relationship between a surface free energy of the development roller 331 and the development ability (the development sensitivity).

The above experiment will be described in detail below. As the experimental machine, a remodeled printer of a printer "ECOSYS FS-1040" manufactured by Kyocera Document Solutions was used. Table 1 shows more detailed experimental conditions.

Other experimental conditions are as follows.

The circumferential speed of the photosensitive drum 31: 118 mm/sec,

The circumferential speed of the development roller 331: 182 mm/sec,

A ratio of the circumferential speed of the development roller 331 to the photosensitive drum 31: 1.55, The development bias DC component: 350 V, The supply bias DC component: 450 V, and The surface potential of the photosensitive drum 31: 640 V.

Figure 8:
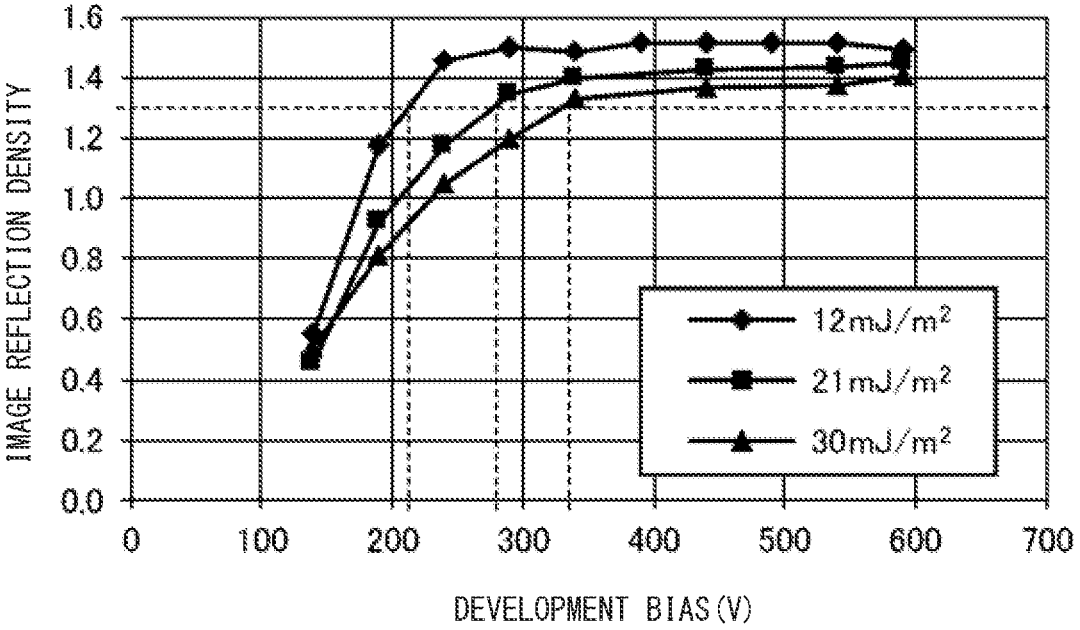
FIG. 8 is a graph showing a relationship between a development bias and an image density in the development device according to the embodiment of the present disclosure.

FIG. 8 is a graph showing a relationship between a development bias and an image density of the development device 33 according to the present embodiment, obtained through the above experiment. In this experiment, three kinds of development rollers 331 having surface free energies of the outer layer different from each other (12, 21, 30 $mJ/m^2$) were prepared. In the present embodiment, although a urethane resin coating is employed as the surface layer coating of the development roller 331, in order to reduce the surface free energy, another material having fluorine or silicone in the molecular structure is added to the urethane, and the surface free energy is adjusted by increasing or decreasing the amount of the material. The surface free energy of the development roller 331 was measured by an OCA 20 manufactured by Hidehiro Seiki.

As shown in FIG. 8, it was confirmed that the smaller the surface free energy of the development roller 331 is, the higher the image density is and the better the development ability is even if the development bias is low. It is inferred that this phenomenon is caused by the fact that the lower the surface free energy is, the lower the non-electrostatic adhesion force between the development roller 331 and the toner is. As described above, in the present embodiment, the adhesion force between the toner and the surface of the development roller 331 is adjusted by adjusting the surface

TABLE 1

| MEMBER | ITEM | CHARACTERISTIC | REMARK |
|---|---|---|---|
| DEVELOPMENT ROLLER | MATERIAL | SILICON RUBBER + URETHANE COATING | NOK Co. Ltd. |
| | RUBBER LAYER THICKNESS (mm) | 3.5 | |
| | OUTER DIAMETER (mm) | ϕ13 | |
| | SHAFT DIAMETER (mm) | ϕ6 | |
| | RUBBER LENGTH (mm) | 232 | |
| | CIRCUMFERENTIAL SPEED (mm/s) | 195 | |
| | HARDNESS (°) | 45 | KOBUNSHI KEIKI CO., Ltd. MD1 |
| | RESISTANCE (logΩ) | 7.1 | MEASURED IN ROTATING IN CONTACT WITH METAL ROLLER AND APPLYING +100 V |
| REGULATING BLADE | MATERIAL | SUS304 | |
| | FREE LENGTH (mm) | 10 | |
| | REGULATING PRESSURE | ADJUSTED BY CHANGING BITING AMOUNT AND THICKNESS | |
| TONER | MATERIAL | POLYESTER RESIN | KYOCERA Document Solutions Japan Inc. |
| | PRODUCTION METHOD | POLYERIZATION | |
| | CENTRAL PARTICLE DIAMTER (μm) | 6.8 | Beckman Colter, Inc. LS-230 particle size analyzer |
| | CIRCULARITY | 0.96 | Synex Corporation FPIA-3000 |
| | MELT VISCOSITY: 90° C. (Pa · s) | 200000 | |
| PHOTOSENSITIVE DRUM | MATERIAL | POSITIVE CHARGE MONOLAYER OPC | Shimadzu Corporation CFT-500EX FLOWTESTER |
| | OUTER DIAMETER (mm) | ϕ24 | KYOCERA Document Solutions Japan Inc. |
| | PHOTOSENSITIVE LAYER THICKNESS (μm) | 22 | |
| CHARGING DEVICE | METHOD | SCOROTRON TYPE CORONA CHARGER | |

free energy of the development roller 331, and as a result, the development ability of the toner is adjusted.

As another method for adjusting the surface free energy, a powder of zinc stearate may be previously applied to the surface of the development roller 331, and an amount of the zinc stearate applied to surface may be adjusted in order to reduce the surface free energy. However, in this case, since the zinc stearate powder may sequentially fall off as the development roller 331 rotates, it is difficult to confirm the long-term effect as compared with the above-described method in which the molecular structure is changed. However, it was confirmed that the same results as those shown in FIG. 8 can be obtained only by the experiment for verifying the contribution of the surface free energy to the development ability.

Figure 9:
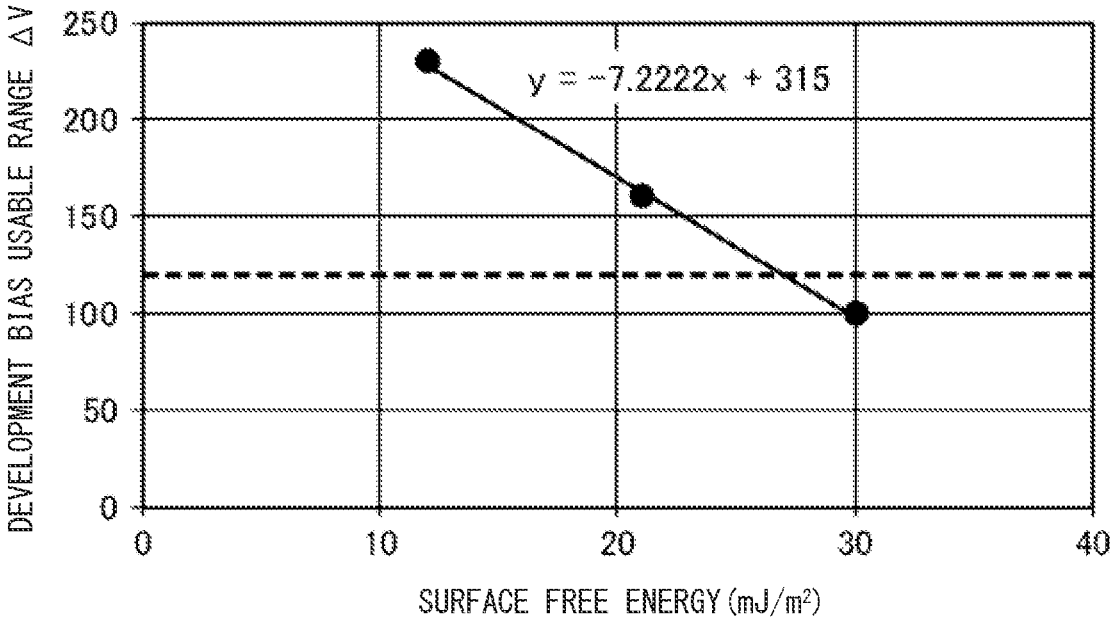
FIG. 9 is a graph showing a relationship between a surface free energy of the development roller and a development bias usable range in the development device according to the embodiment of the present disclosure.

FIG. 9 is a graph showing a relationship between the surface free energy of the development roller 331 and the development bias usable range in the development device 33 according to the present embodiment. FIG. 9 shows an evaluation of the width of the usable range of the development bias in each development roller 331 by performing the same evaluation as in FIG. 4 in each development roller 331 whose surface free energy is changed as described above. FIG. 9 shows how the width of the usable range in which the target image density is a reflection density of 1.3 or more and the cleaning failure does not occur is changed with respect to the surface free energy. Because the target value of the usable range of the development bias is A120 V or more, the target can be achieved if the surface free energy is 27 $mJ/m^2$ or less. It should be noted that the smaller the surface free energy is, the better the development ability is, but the value of the development bias at which the cleaning failure does not occur does not change.

Figure 10:
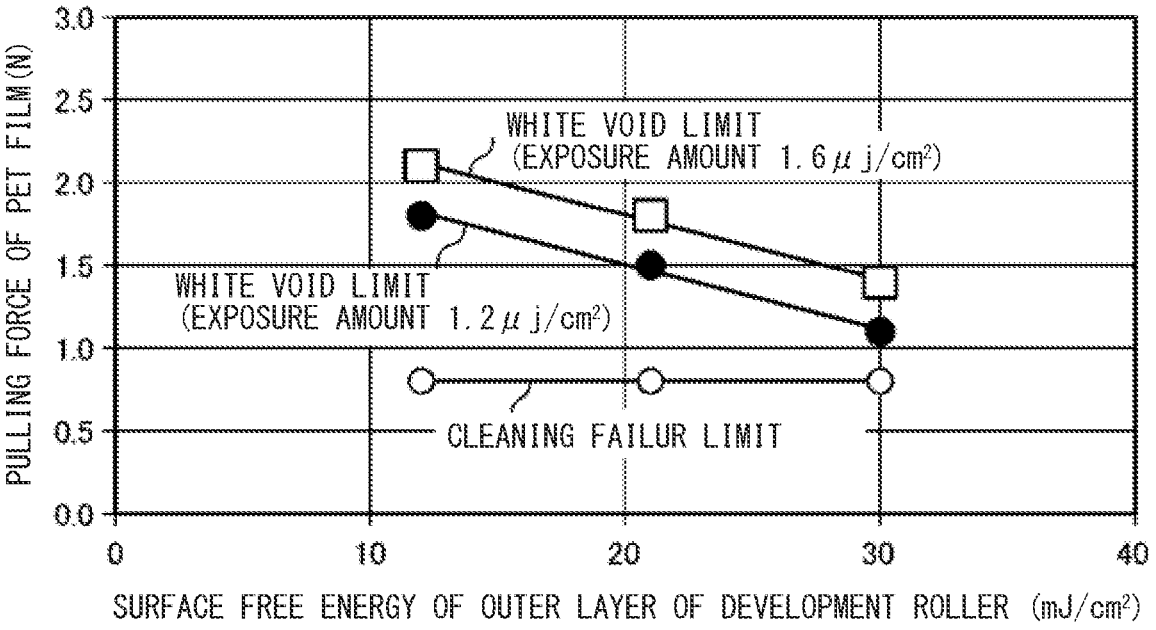
FIG. 10 is a graph showing a relationship between a surface free energy of the development roller and a pulling force in the development nip area in the development device according to the embodiment of the present disclosure.

FIG. 10 is a graph showing a relationship between the surface free energy of the development roller 331 and the pulling force in the development nip area in the development device 33 according to the present embodiment. In the three development rollers 331 having different surface free energies, an appropriate range of the pressing force (the pulling force of the PET film) was obtained as shown in FIG. 10, from a limit value due to the white void in the halftone image and a limit value due to the occurrence of the cleaning failure. As shown in FIG. 10, as the surface free energy of the development roller 331 is lower, the insufficiency of the image density that occurs when the pressing force in the development nip area is large is less likely to occur, and the appropriate range of the pressing force (the pulling force) becomes wider. The two graphs of the limit of the white void in the halftone image shown in FIG. 10 are obtained by linearly regressing the limits of the white void in the halftone image in the development rollers 331 having three different surface free energies, and are graphs under two conditions in which the exposure amount to the photosensitive drum 31 is different from each other.

As described above, from the viewpoint of the development bias usable range (FIG. 9), it has been found that the surface free energy E of the development roller 331 is preferably set to 27 $mJ/m^2$ or less, and at this time, in order to prevent the cleaning failure (FIG. 10), the pulling force F at the development nip area preferably satisfies 0.8 (N)≤F, and further, in order to prevent the generation of the white void in the halftone image (FIG. 10), when the exposure amount to the photosensitive drum 31 is 1.2 $\mu J/cm^2$, by setting the pulling force F to equal to or less than the graph based on the black circle data in FIG. 10, that is, by satisfying $F \leq -0.0389 \times E + 2.2833$, good image quality is obtained. In addition, it has been found that in order to prevent the generation of the white void in the halftone image (FIG. 10), when the exposure amount to the photosensitive drum 31 is 1.6 $\mu J/cm^2$, by setting the pulling force F to equal to or less than the graph based on the white square data in FIG. 10, that is, by satisfying $F \leq -0.0389 \times E + 2.5833$, good image quality can be obtained.

As a result of examining the above two graphs, the present inventors have newly found that when the exposure amount to the photosensitive drum 31 is increased, it becomes possible to expand a region where the white void in the halftone image is not generated to a side where the pulling force F is large. It is inferred that this is caused by the fact that, by increasing the exposure amount, the more amount of the toner is developed for the fine toner image (1 dot) constituting the halftone image, and the influence of the development performance is reduced. Further, in the case of a positively charged drum like the photosensitive drum 31 according to the present embodiment, when the exposure amount by the exposure devices 35 is increased, the potential of the image formed portion on the photosensitive drum 31 becomes lower (closer to 0 V). At this time, it is inferred that, since a difference in potential between the exposed portion (the image formed portion, 1 dot portion) and the unexposed portion (the no-image formed portion, a blank portion around the 1 dot portion) is further increased and a sneak electric field is increased (the electric lines of force are densely packed), a toner holding force on the surface of the photosensitive drum 31 is increased, and the white void in the halftone image is less likely generated. Further, when the exposure amount is increased as described above, it is inferred that because a size of 1 dot is increased, a development pressure (a pressure with which the development roller 331 is pressed on the photosensitive drum 31) becomes large, and a change in the density is difficulty viewed even if the development property decreases. When the exposure amount is increased and the size of 1 dot on the photosensitive drum 31 is increased, the density of the halftone image is originally increased, but since the density of a dot is adjusted for each gradation of the halftone image in the image processing in the image forming apparatus 1, the density on the naked eye is adjusted to be substantially equal even when the exposure amount is actually increased.

Figure 11:
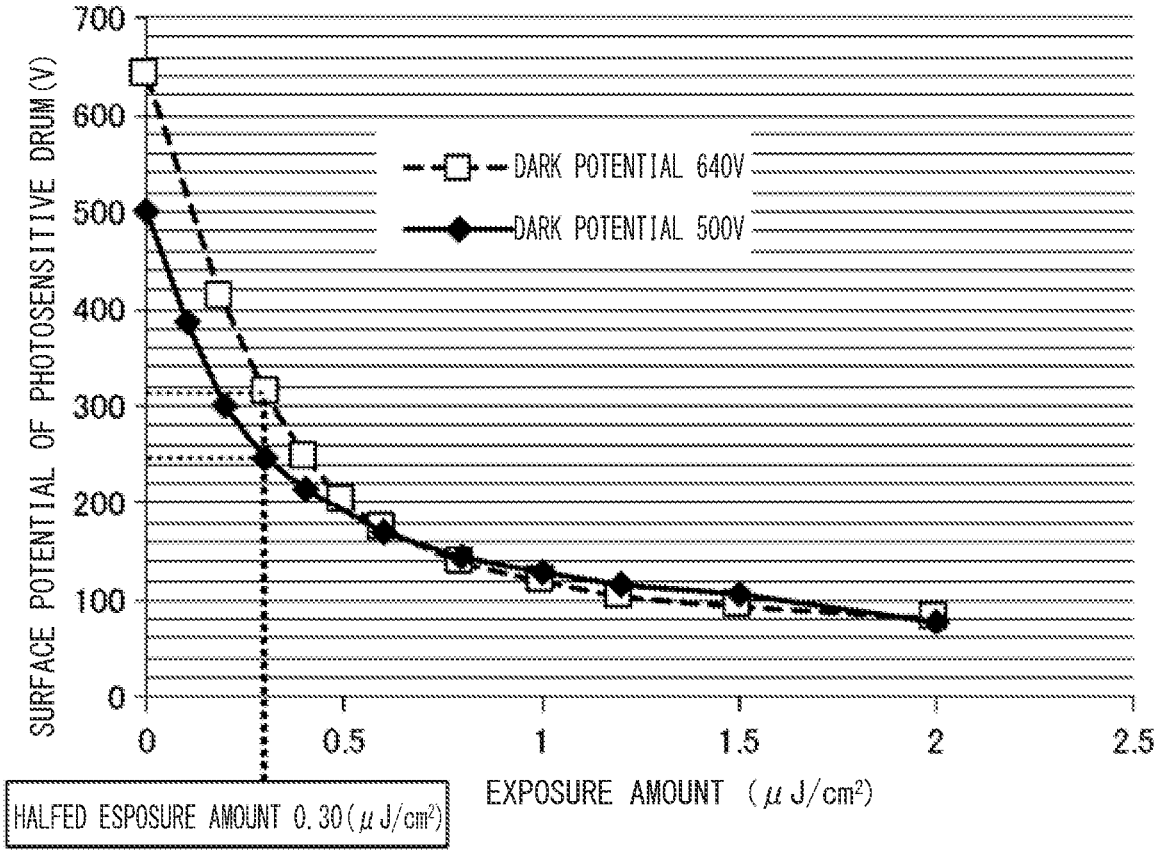
FIG. 11 is a graph showing a relationship between an exposure amount and a surface potential of a photosensitive drum in the embodiment of the present disclosure.
Figure 12:
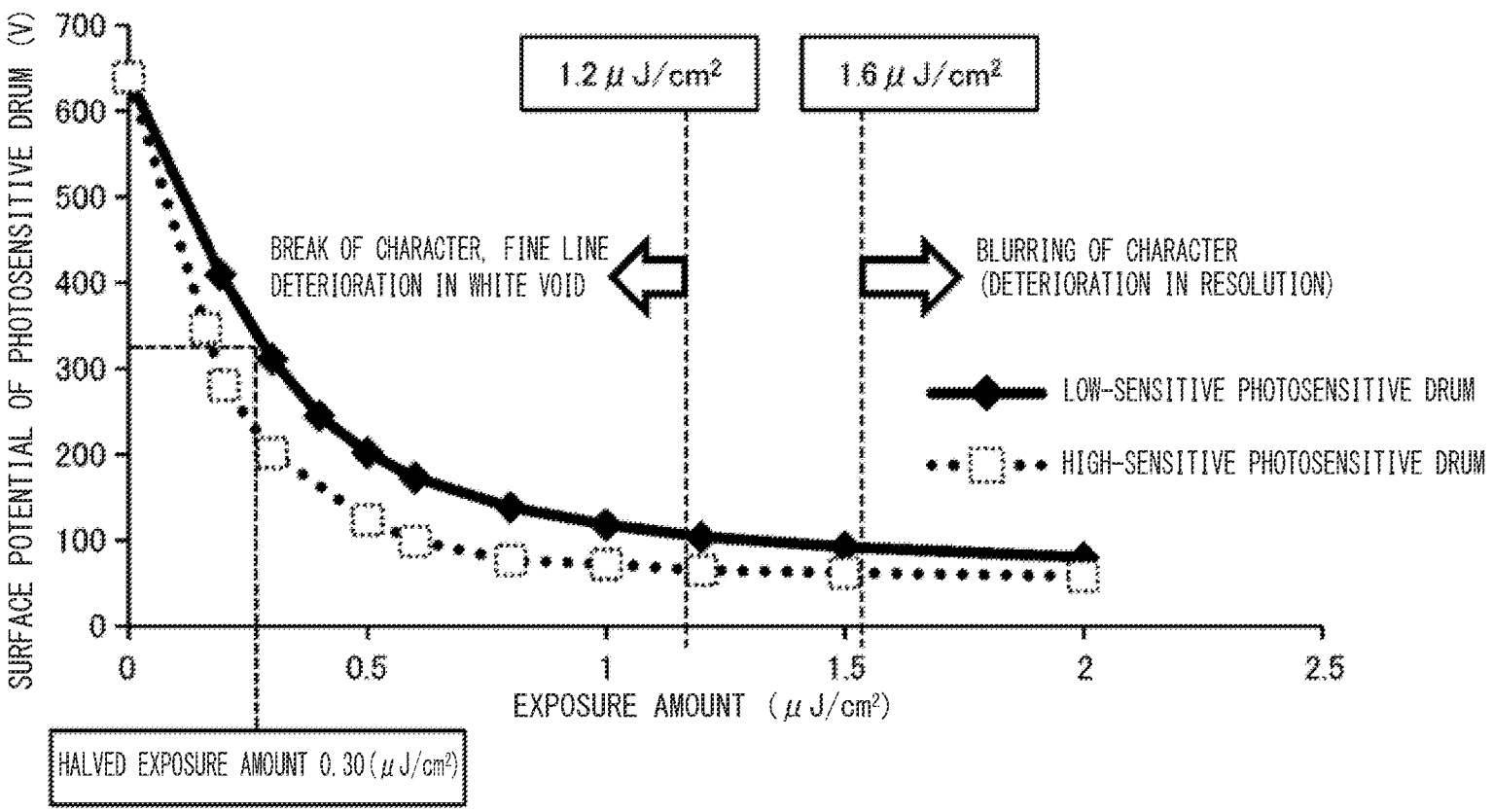
FIG. 12 is a graph showing a relationship between an exposure amount on the photosensitive drum and an image quality.

Table 2 shows each image evaluation result when the exposure amount to the photosensitive drum 31 is increased or decreased. FIG. 11 is a graph showing a relationship between the exposure amount and the surface potential of the photosensitive drum 31 according to the present embodiment. FIG. 12 is a graph showing a relationship between the exposure amount to the photosensitive drum and the image quality, and visualizes the results of Table 2. In the evaluation shown in Table 2, the experiments were carried out using the development roller 331 having the surface free energy of 12 $mJ/m^2$.

TABLE 2

| SURFACE FREE ENERGY OF OUTER LAYER OF DEVELOPMENT ROLLER ($mJ/m^2$) | EXPOSURE AMOUNT ($\mu J/cm^2$) | IMAGE DENSITY | CHARACTER, FINE LINE | RESOLUTION (BLURRING OF CHARACTER) | PET FILM PULLING FORCE (N) WHEN WHITE VOID OCCURS |
|---|---|---|---|---|---|
| 12 | 0.8 | x (INSUFFICIENT) | x (BREAKS) | ○ | 1.2 |
| | 0.9 | x (INSUFFICIENT) | x (BREAKS) | ○ | 1.4 |
| | 1.0 | ○ | x (BREAKS) | ○ | — |
| | 1.1 | ○ | x (BREAKS) | ○ | — |
| | 1.2 | ○ | ○ | ○ | 1.8 |
| | 1.3 | ○ | ○ | ○ | — |
| | 1.4 | ○ | ○ | ○ | — |
| | 1.5 | ○ | ○ | ○ | — |
| | 1.6 | ○ | ○ | ○ | 2.1 |
| | 1.7 | ○ | ○ | x (BLURRING) | — |
| | 1.8 | ○ | ○ | x (BLURRING) | — |
| | 1.9 | ○ | ○ | x (BLURRING) | — |
| | 2.0 | ○ | ○ | x (BLURRING) | 2.3 |

As shown in Table 2, it is found that the larger the exposure amount is, the larger the pulling force F corresponding to a generation limit of the white void in the halftone image is. Further, if the exposure amount is too small, the sufficiency of the image density and breaks of a character image and a fine line occur. On the other hand, if the exposure amount is too large, the toner is excessively developed, and failures such as blurring of a character image occur. As a result, as shown in FIG. 12, the exposure amount to the photosensitive drum 31 is preferably set to a range of 1.2 $\mu J/m^2$ or more and 1.6 $\mu J/m^2$ or less.

It becomes possible to make the cost of the photosensitive drum 31 low by decreasing an amount of a material for exhibiting a photoconductive action, such as a charge generating material or a charge transporting material contained in the photosensitive layer of the photosensitive drum 31 as small as possible. Because the smaller the amount of these materials is, the lower the sensitivity of the photosensitive drum 31 is, a relatively large exposure amount is required. In other words, by using the photosensitive drum 31 having a relatively low sensitivity, it becomes possible to increase the exposure amount at the time of the normal image formation, and it becomes possible to widen the area where the white void in the halftone image is not generated.

As shown in FIG. 11, in the photosensitive drum 31 according to the present embodiment, the surface potential is reduced by half to 50% by setting the exposure amount to 0.30 $\mu J/cm^2$ in both cases where the dark potential, that is the initial charge potential is 640 V and 500 V. That is, when the halved exposure amount, which is the exposure amount by which the surface potential of the photosensitive drum 31 is reduced by half, is 0.30 $\mu J/cm^2$ or more, the sensitivity of the photosensitive drum 31 becomes relatively low as described above, so that it becomes possible to increase the exposure amount at a time of the normal image formation, and it becomes possible to stably expand the area where the white void in the halftone image is not generated. As shown in FIG. 11, in the case of the photosensitive drum 31 having the same material structure, the halved exposure amount is substantially constant regardless of the initial surface potential (dark potential).

As described above, in the case where the exposure amount to the photosensitive drum 31 is 1.2 $\mu J/cm^2$ or less, when the pulling force F is equal to or below the graph based on the black circle data in FIG. 10, that is when $F \leq -0.0389 \times E + 2.5833$ is satisfied, good image quality without the white void in the halftone image can be obtained. On the other hand, in the case where the exposure amount to the photosensitive drum 31 is 1.6 $\mu J/cm^2$, it has been found that when the pulling force F is equal to or less than the graph based on the white square data in FIG. 10, that is, $F \leq -0.0389 \times E + 2.5833$ is satisfied, good image quality without the white void in the halftone image can be obtained. That is, it has been newly found that when the exposure amount to the photosensitive drum 31 is increased, it becomes possible to expand a region where the white void in the halftone image is not generated to a side where the pulling force F is large.

Figure 13:
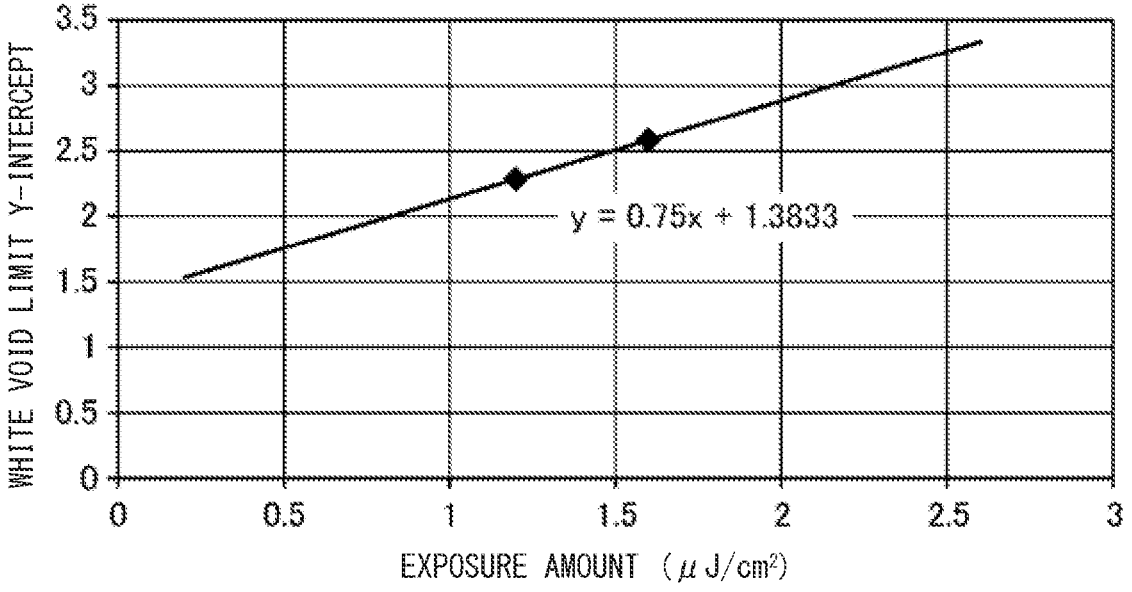
FIG. 13 is a graph showing a relationship between an exposure amount on the photosensitive drum and a Y-intercept of the graph shown in FIG. 10.

FIG. 13 is a graph showing a relationship between the exposure amount for the 100% solid image to the photosensitive drum 31 and the y-intercept of the graph of FIG. 10. In FIG. 13, the inventors have newly derived the following equation (1) as a regression line passing through 2 points, where the exposure amounts of 1.2 $\mu J/m^2$ and 1.6 $\mu J/cm^2$ to the photosensitive drum 31 are plotted on the horizontal axis, and 2.2833 and 2.5833, which are the y-intercepts of the corresponding linear equations, are plotted on the vertical axis.

$$y = 0.75 \times x + 1.3833 \quad \text{(Equation 1).}$$

Therefore, in FIG. 10, a boundary line (the black circle data and the white square data in FIG. 10) of the pulling force of the PET film at which the white void in the halftone image is not generated is changed so as to satisfy the following Equation 2 by using the value of the surface free energy E of the surface layer of the development roller 331 and the exposure amount G to the photosensitive drum 31 as variables.

$$F \leq -0.0389 \times E + (0.75 \times G + 1.3833) \quad \text{(Equation 2).}$$

In the above evaluation, it has been found that when the surface free energy E of the development roller 331 lowers below 5 $mJ/m^2$, the adhesion force of the toner on the development roller 331 becomes too low, and the toner is hardly attracted to the development roller 331 when the toner is supplied from the supply roller 332 to the development roller 331, and the stability of the toner layer is lowered. Therefore, the surface free energy E is preferably set in a range of 5 $mJ/m^2$ or more and 27 $mJ/m^2$ or less.

As described above, according to the present embodiment, in a state where the surface free energy E of the development roller 331 is contained in a range of 5 $mJ/m^2$ or more and 27 $mJ/m^2$ or less and the toner carrying amount on the development roller 331 regulated by the regulating blade 334 is set in a range from 1 $g/m^2$ or more to 10 $g/m^2$ or less, when the value of the pulling force is set to F (N) and the surface free energy of the development roller 331 is set to E ($mJ/m^2$), the relational expression of $0.8 \leq F \leq -0.0389 \times E + 2.2833$ is satisfied, in which the pulling force is obtained in such a manner that a PET film having a thickness of 50 μm is held in the development nip area and then a force applied to the film is measured on the upstream side of the development nip area in the rotational direction of the development roller 331 when the film is pulled toward the downstream side in the rotational direction of the development roller 331 as the photosensitive drum 31 and the development roller 331 are rotated. Further, according to the present embodiment, in a state where the photosensitive drum 31 is emitted with exposure light at an exposure amount of 1.2 $\mu J/cm^2$ or more and 1.6 $\mu J/cm^2$ or less in accordance with image information of the 100% solid image, the surface free energy E of the development roller 331 is contained in a range of 5 $mJ/m^2$ or more and 27 $mJ/m^2$ or less, and the toner carrying amount on the development roller 331 regulated by the regulating blade 334 is set in a range of 1 $g/m^2$ or more and 10 $g/m^2$ or less, when the value of the pulling force is set to F (N), the surface free energy of the development roller 331 is set to E ($mJ/m^2$) and the exposure amount is G ($\mu J/cm^2$), the relational equation of $0.8 \leq F \leq -0.0389 \times E + (0.75 \times G + 1.3833)$ is satisfied, in which the pulling force is obtained in such a manner that a PET film having a thickness of 50 μm is held in the development nip area and then a force applied to the film is measured on the upstream side of the development nip area in the rotational direction of the development roller when the film is pulled toward the downstream side in the rotational direction of the development roller as the photosensitive drum and the development roller are rotated.

As described above, by setting the surface free energy of the development roller 331 within a predetermined range, the development ability can be improved, the usable range of the development bias and the pressing setting range of the development roller can be made more wider, and stable image formation can be achieved even in a simple and low-cost configuration.

In the present embodiment, the development roller 331 has the rubber layer as an elastic body and the coating layer formed around the surface of the rubber layer.

According to this configuration, the development ability of the development roller 331 can be stably maintained. In another embodiment, the development roller 331 may be formed by polishing the surface of the rubber layer (the base layer rubber) of the base layer without having the coating layer as described above. On the other hand, by providing the coating layer as described above, it becomes possible to accurately and independently control the surface roughness, the surface free energy and the others of the development roller 331 without being affected by the property of the base layer rubber. In particular, the surface roughness can be controlled by dispersing resin or silica beads in the coating layer, and the surface free energy can be increased or decreased by changing the material as described above. The electric resistance of the development roller 331 may also be changed by increasing or decreasing the amount of ion conductive agent or carbon in the coating agent constituting the coating layer. As described above, since the development roller 331 has the coating layer, it becomes possible to obtain a desired quality and a characteristic suitable for the cost.

In this embodiment, the development housing 330 stores the toner produced by a pulverizing method.

When the toner used in the development device 33 is a polymerized toner (having a high degree of circularity), the same effect as described above can be obtained, but since the polymerized toner is originally spherical, the adhesion force of the toner to the surface of the development roller 331 is low and the development ability is good, so that the development bias usable range is wide. On the other hand, in the present embodiment, even if the pulverized toner, which is ununiform as compared with the polymerized toner and has a high adhesion force to the surface of the development roller 331, is used, the development ability can be improved, the development bias usable range and the pressing setting range of the developing roller can be made wider, and stable image formation can be achieved. As a result, the low-cost image forming apparatus 1 can be realized by using the pulverized toner whose cost is lower than the polymerized toner.

The image forming apparatus 1 according to the present embodiment has a cleanerless structure in which a cleaning member (a cleaning blade, a cleaning brush) for cleaning the untransferred toner remaining on the photosensitive drum 31 is not disposed in a region from the downstream side area of the transferring roller 34 in the rotational direction of the photosensitive drum 31 and the upstream side area of the development nip area in the rotational direction of the photosensitive drum 31. Therefore, the low-coat image forming apparatus 1 can be realized compared with other image forming apparatuses having the cleaning member.

The present inventors have confirmed that the above effects are obtained under the following conditions.

Figure 14:
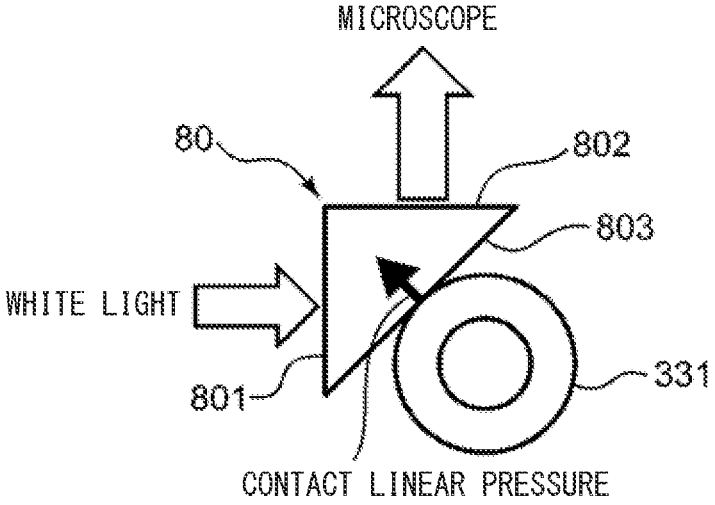
FIG. 14 is a view showing a way to measure a contact area ratio of the development roller.

The contact area ratio of the development roller 331 is preferably set in a range of 4.5% or more and 10% or less, more preferably a range of 6% or more and 8% or less. FIG. 14 is a view showing a state in which the contact area ratio of the development roller 331 is measured. As shown in FIG. 14, a triangular prism-shaped glass prism 80 having outer surfaces 801 and 802 which are disposed perpendicular to each other, and an outer surface 803 which is disposed so as to intersect with the outer surfaces 801 and 802 at 45° is prepared. That is, the prism 80 has a cross section of a right isosceles triangle. The development roller 331 is disposed such that the circumferential face of the development roller 331 is brought into contact with the outer surface 803 of the prism 80 at a contact line pressure of 1 N/m. Then, white light is emitted to the contact area between the circumferential face of the development roller 331 and the outer surface 803 through the outer surface 801 of the prism 80, and an image of the contact area between the circumferential face of the development roller 331 and the outer surface 803 projected on the outer surface 802 of the prism 80 may be photographed by a microscope. For example, a white LED light source "IHM-25" manufactured by Raymac Corporation may be used as a light source for emitting the white light. For the microscope, a "KH-8700" manufactured by HiROX can be used. The black region in the photographed image is a region where the white light emitted through the outer surface 801 of the prism 80 is absorbed because the circumferential face of the development roller 331 and the outer surface 803 of the prism 80 are actually in contact with each other. That is, the black region is considered to be a region of the circumferential face of the development roller 331 excluding the concave portion. In other words, the non-black region in the photographed image is a region where the circumferential face of the development roller 331 and the outer surface 803 of the prism 80 are not in contact with each other, and is considered to be a region of the concave portion in the circumferential peripheral face of the development roller 331. Therefore, the photographed image is subjected to a binarization process, and a ratio of the area of the black region to the area of the image after the binarization process (=area of the black region/area of the image after the binarization process) can be calculated as the contact area ratio of the circumferential face of the development roller 331.

Further, when the regulating blade 334 is pressed against the surface of the development roller 331, the regulation pressure is preferably set within a range of 10 N/m or more and 60 N/m or less, and more preferably set within a range of 15 N/m or more and 25 N/m or less.

The surface roughness of the development roller 331 may be set by covering it with a coating layer including powder, or by polishing a raw tube of the development roller 331, and the method is not limited to the above ways. The surface roughness Rz of the development roller 331 is preferably set to a range of 2 μm or more and 4 μm or less, the surface roughness Sm is preferably set to a range of 12 μm or more and 290 μm or less, and Sm/Rz is preferably set to a range of 30 or more and 145 or less.

The above experiment is carried out in a condition where the average particle diameter of the used toner is 6.8 μm (D50), and it is confirmed that the same results are obtained in a range of 6.0 μm or more and 8.0 μm or more. When the average particle diameter of the toner is selected from this range, the particle diameter smaller than 6.0 μm is not preferable because it leads to an increase in the manufacturing cost of the toner, and the particle diameter larger than 8.0 μm is not preferable because it leads to an increase in the toner consumption, which deteriorates the fixing ability, and in addition, deteriorates the image quality.

The above experiment is carried out under a condition where the circularity of the toner is 0.96, and it is confirmed that the same results are obtained in a range of 0.93 or more and 0.97 or less. The circularity less than 0.93 is not preferable because the image quality tends to deteriorate. Further, the circularity more than 0.97 is not preferable because the manufacturing cost is greatly increased.

Further, for the circumferential speed difference between the photosensitive drum 31 and the development roller 331, it is confirmed that the same results are obtained in a range of 1.1 or more and 1.6 or less (the surface speed of the development roller 331 is higher than that of the photosensitive drum 31). The circumferential speed difference smaller than 1.1 is not preferable because toner fogging, in which the toner adheres to the white image portion, is generated. In addition, the circumferential difference larger than 1.6 is not preferable from the viewpoint of the lifetime of the apparatus because the drive torque, vibration of the apparatus, and stress of the toner increase.

In addition, it has been confirmed that the same results are obtained for each bias when the surface potential of the photosensitive drum 31 is within a range of 500 V or more and 800 V or less and the potential of the photosensitive drum 31 after exposed is within a range of 70 V or more and 200 V or less.

In particular, when the surface free energy of the development roller 331 is low, in order to adhere the toner to the development roller 331 stably, the material of the supply roller 332 is preferably a foamed material (for example, urethane foam rubber), the supply roller 332 preferably has an outer diameter equal to or larger than an outer diameter of the development roller 31, and the supply roller 331 rotates in the same direction as the development roller 331 (=a counter direction at the nip area, in contact in the reverse direction). The biting amount between the development roller 331 and the supply roller 332 is preferably 0.5 mm or more, more preferably within a range of 0.5 mm or more and 1.0 mm or less. If the biting amount is too smaller than 0.5 mm, the supply amount tends to decrease, and if the biting amount is too large, the drive torque of the development device increases, and permanent deformation of the supply nip area due to long leaving tends to occur.

The voltage applied to the supply roller 332 is preferably equal to or higher than the potential of the development roller 331. More preferably, a voltage of +100 V or more is applied to the development roller 331.

As described above, when the PET film is held in the development nip area and the pulling force is measured, the toner on the photosensitive drum 31 and the development roller 331 is actually in contact with the PET film. It has been confirmed that the above effects are obtained when the toner carrying amount on the development roller 331 is within a range of at least 1 $g/m^2$ or more and 10 $g/m^2$ or less. If the toner carrying amount is less than 1 $g/m^2$, the amount of the toner developed on the photosensitive drum 31 is too small, and the image density is too low. On the other hand, in the range of more than 10 $g/m^2$, the consumed amount of the toner is large, the cost is increased, and the amount of the toner on the sheet is too large to heat-fix the toner on the sheet. Therefore, it is desirable to set it in the range of 1 $g/m^2$ or more and 10 $g/m^2$ or less.

Further, the same evaluation result (effect) as described above was reproduced in a range in which the diameter of the development roller 331 is within a range of 11.0 mm or more and 15.0 mm or less. Similarly, the same evaluation result (effect) as described above was reproduced when the circumferential speed ratio of the development roller 331 to the supply roller 332 is within a range of 1.3 or more and 1.8 or less (the circumferential speed of the development roller 331 is higher than that of the supply roller).

Further, it has been confirmed that the surface roughness, the circumferential speed ratio of the development roller 331 to the supply roller 332 and the carrying amount of the toner on the development roller 331 do not significantly affect the above relational expression.

Although the development device 33 according to the present embodiment and the image forming apparatus 1 including the development device 33 have been described above, the present disclosure is not limited thereto, and for example, the following modified embodiment can be employed.

(1) In the above embodiment, the image forming apparatus 1 is provided with one development device 33, but the image forming apparatus 1 may be a color image forming apparatus having development devices 33 corresponding to a plurality of colors.

(2) In the embodiment described above, the development housing 330 of the development device 33 stores the nonmagnetic toner therein, but the development device 33 may have a toner container and a toner cartridge for storing the nonmagnetic toner in addition to the development housing 330.

The invention claimed is:

1. A development device comprising:

a development housing in which a nonmagnetic one-component toner is stored;

a development roller formed by a cylindrical elastic body, supported by the development housing in a rotatable manner so as to move in a same direction as a rotational direction of a rotatable photosensitive drum at a development nip area while coming into contact with the photosensitive drum, and having a circumferential face on which the toner is carried, the photosensitive drum having a surface on which an electrostatic latent image is carried;

a supply roller formed by a cylindrical elastic body, supported by the development housing in a rotatable manner, coming into contact with the circumferential face of the development roller to form a supply nip area between the supply roller and the development roller, supplying the toner to the development roller and collecting the toner from the development roller; and a layer thickness regulating member coming into contact with the circumferential face of the development roller on a downstream side of the supply nip area in a rotational direction of the development roller and on an upstream side of the development nip area in the rotational direction of the development roller, and regulating a thickness of the toner on the development roller, wherein the development roller has a surface free energy within a range of 5 $mJ/m^2$ or more and 27 $mJ/m^2$ or less, the photosensitive drum is exposed with exposure light having an exposure amount of 1.2 $\mu J/cm^2$ or more to 1.6 $\mu J/cm^2$ or less based on image data to carry the electrostatic latent image on the surface, and when a pulling force is represented as F (N), the exposure amount is represented as G ($\mu J/cm^2$) and the surface free energy is represented as E ($\mu J/m^2$), the following relationship equation is satisfied, $$0.8 \leq F \leq -0.0389 \times E + (0.75 \times G + 1.3833),$$

wherein the pulling force is obtained in such a manner that a PET film having a thickness of 50 μm is held in the development nip area and then a force applied to the film is measured on the upstream side of the development nip area in the rotational direction of the development roller when the film is pulled toward the downstream side in the rotational direction of the development roller as the photosensitive drum and the development roller are rotated.

2. The development device according to claim 1, wherein the development roller has a rubber layer as the elastic body and a coating layer formed around a circumferential face of the rubber layer.

3. The development device according to claim 1, wherein the development housing stores the toner produced by pulverization method.

4. The development device according to claim 1, wherein the development roller has an Asker-C hardness of 50 or more to 80 or less, and the supply roller has an Asker-FP hardness of 40 or more to 60 or less.

5. The development device according to claim 1, wherein the supply roller is made of foamed material, has an outer diameter larger than an outer diameter of the development roller, and moves in a direction opposite to the development roller at the supply nip area.

6. The development device according to claim 1, wherein the development roller has a toner carrying amount of 1000 $mg/cm^2$ to 1000 $mg/cm^2$.

7. An image forming apparatus comprising:

the development device according to claim 1;

the photosensitive drum which receives the toner from the development roller and carries a toner image corresponding to the electrostatic latent image; and a transferring member which transfers the toner image from the photosensitive drum to a sheet, wherein the development device comprising:

a development housing in which a nonmagnetic one-component toner is stored;

a development roller formed by a cylindrical elastic body, supported by the development housing in a rotatable manner so as to move in a same direction as a rotational direction of a rotatable photosensitive drum at a development nip area while coming into contact with the photosensitive drum, and having a circumferential face on which the toner is carried, the photosensitive drum having a surface on which an electrostatic latent image is carried;

a supply roller formed by a cylindrical elastic body, supported by the development housing in a rotatable manner, coming into contact with the circumferential face of the development roller to form a supply nip area between the supply roller and the development roller, supplying the toner to the development roller and collecting the toner from the development roller; and a layer thickness regulating member coming into contact with the circumferential face of the development roller on a downstream side of the supply nip area in a rotational direction of the development roller and on an upstream side of the development nip area in the rotational direction of the development roller, and regulating a thickness of the toner on the development roller, wherein the development roller has a surface free energy within a range of 5 $mJ/m^2$ or more and 27 $mJ/m^2$ or less, and the photosensitive drum has a halved exposure amount of 0.3 ($\mu J/cm^2$) which is an exposure amount for reducing a surface potential of the photosensitive drum by half.

8. The image forming apparatus according to claim 7, having a cleanerless structure in which a cleaning member for cleaning an untransferred toner remaining on the photosensitive drum is not disposed within a region on a downstream side of the transferring member in a rotational direction of the photosensitive drum and on an upstream side of the development nip area in the rotational direction of the photosensitive drum.

9. A development device comprising:

a development housing in which a nonmagnetic one-component toner is stored;

a development roller formed by a cylindrical elastic body, supported by the development housing in a rotatable manner so as to move in a same direction as a rotational direction of a rotatable photosensitive drum at a development nip area while coming into contact with the photosensitive drum, and having a circumferential face on which the toner is carried, the photosensitive drum having a surface on which an electrostatic latent image is carried;

a supply roller formed by a cylindrical elastic body, supported by the development housing in a rotatable manner, coming into contact with the circumferential face of the development roller to form a supply nip area between the supply roller and the development roller, supplying the toner to the development roller and collecting the toner from the development roller; and a layer thickness regulating member coming into contact with the circumferential face of the development roller on a downstream side of the supply nip area in a rotational direction of the development roller and on an upstream side of the development nip area in the rotational direction of the development roller, and regulating a thickness of the toner on the development roller, wherein the development roller has a surface free energy within a range of 5 $mJ/m^2$ or more and 27 $mJ/m^2$ or less, when a pulling force is represented as F (N) and the surface free energy is represented as E ($\mu J/m^2$), the following relationship equation is satisfied, $$0.8 \leq F \leq -0.0389 \times E + 2.2833,$$

wherein the pulling force is obtained in such a manner that a PET film having a thickness of 50 μm is held in the development nip area and then a force applied to the film is measured on the upstream side of the development nip area in the rotational direction of the development roller when the film is pulled toward the downstream side in the rotational direction of the development roller as the photosensitive drum and the development roller are rotated.

* * * * *